United States Patent [19]

Levy et al.

[11] 3,934,506

[45] Jan. 27, 1976

[54] APPARATUS FOR IMPRINTING INTERMITTENTLY ADVANCED WEBS

[75] Inventors: Murray N. Levy, Spring Valley, N.Y.; Vincent J. Gasparino, West Orange, N.J.

[73] Assignee: Adolph Gottscho, Inc., Union, N.J.

[22] Filed: Apr. 2, 1974

[21] Appl. No.: 457,313

[52] U.S. Cl. ..... 101/260; 101/272; 101/279; 101/356

[51] Int. Cl.[2]..... B41F 3/76; B41F 3/14; B41F 3/20

[58] Field of Search..... 101/260, 269, 353–358, 101/250, 350, 252, 256, 257, 282

[56] References Cited

UNITED STATES PATENTS

| | | | |
|---|---|---|---|
| 502,618 | 8/1893 | Cox | 101/355 |
| 2,375,793 | 5/1945 | Kidrick et al. | 101/269 |
| 2,649,045 | 8/1953 | Finizie et al. | 101/213 |
| 2,711,935 | 6/1955 | Miles | 101/349 |
| 2,855,844 | 10/1958 | Stewart | 101/351 |
| 2,876,001 | 3/1959 | Stenstrom | 101/250 |
| 2,986,088 | 5/1961 | Chase et al. | 101/350 |
| 3,098,435 | 7/1963 | Flower | 101/269 |
| 3,499,383 | 3/1970 | Southam | 101/350 |
| 3,528,335 | 9/1970 | Andolsek | 101/260 |
| 3,575,108 | 4/1971 | Scranton | 101/269 |
| 3,610,148 | 10/1971 | Penaluna | 101/269 |
| 3,744,414 | 7/1973 | Krochert et al. | 101/350 |
| 3,827,356 | 8/1974 | Snow | 101/35 |

FOREIGN PATENTS OR APPLICATIONS

| | | | |
|---|---|---|---|
| 50,466 | 1/1890 | Germany | 101/260 |
| 374,028 | 4/1923 | Germany | 101/260 |
| 146,364 | 7/1936 | Austria | 101/260 |

*Primary Examiner*—Clyde I. Coughenour
*Assistant Examiner*—William Pieprz
*Attorney, Agent, or Firm*—Blum, Moscovitz, Friedman & Kaplan

[57] ABSTRACT

An apparatus for imprinting intermittently advanced webs has a carriage mounted for reciprocal displacement parallel to the web on a support. The web passes between a backup plate and a print roller rotatably mounted on the carriage. The carriage is displaced in one direction while the web is at rest, the print roller being coupled to the support for rotation during displacement of the carriage to effect printing by engaging the web against the backup plate. Printing is effected during displacement of the carriage in both directions.

14 Claims, 8 Drawing Figures

Fig. 4.
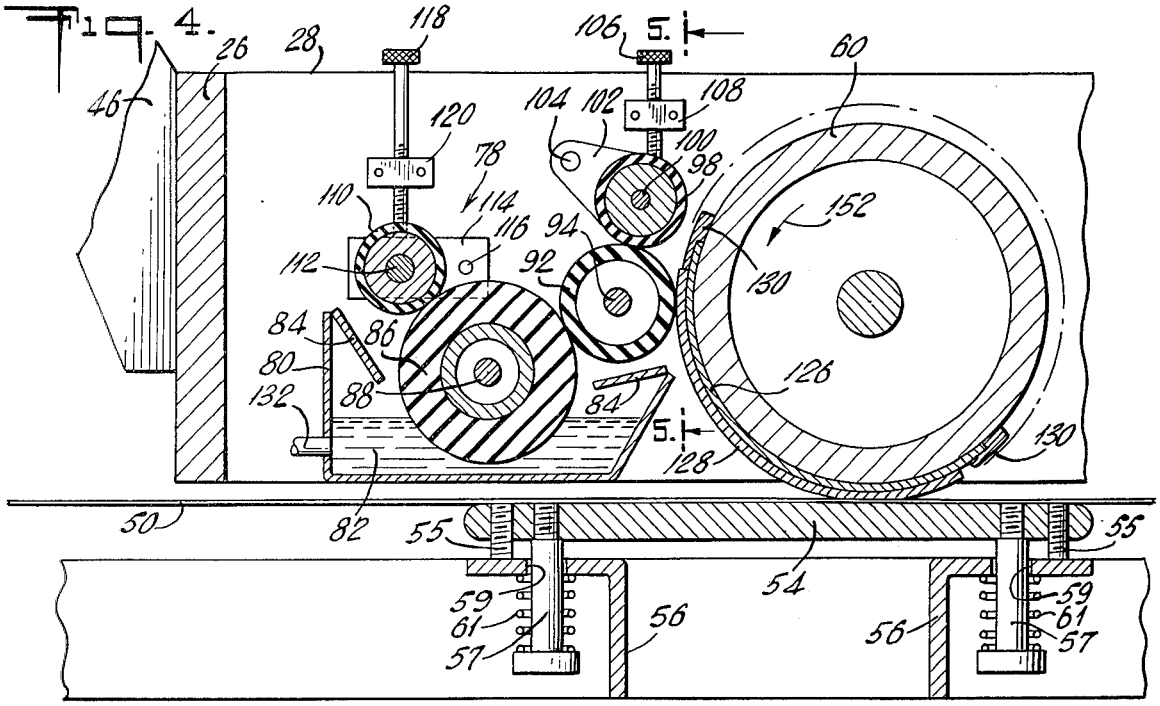
Fig. 5.
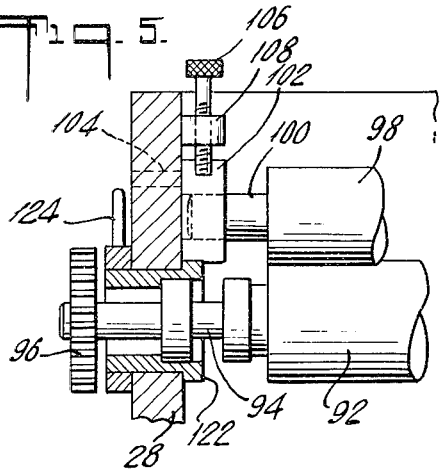
Fig. 6.
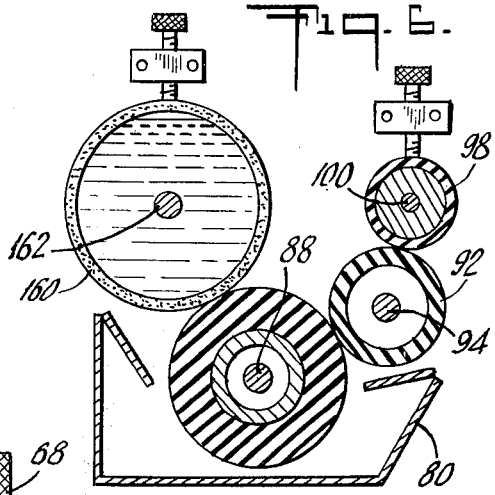
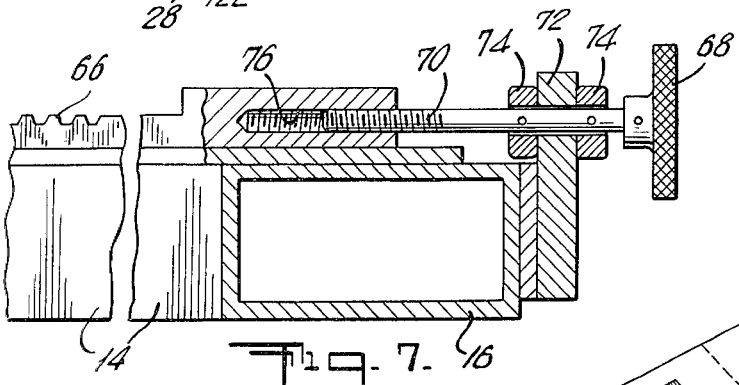
Fig. 7.
Fig. 8.
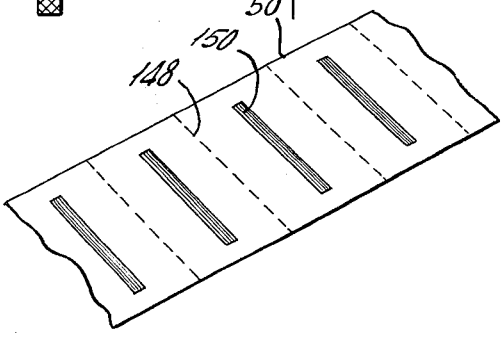

APPARATUS FOR IMPRINTING INTERMITTENTLY ADVANCED WEBS

BACKGROUND OF THE INVENTION

This invention is directed to marking apparatus, and in particular, to apparatus for imprinting intermittently advanced webs. Many packaging techniques utilize intermittently advanced webs of material. These webs may be formed of plastic, paper, foil and the like. Frequently, two sheets of such web material are intermittently fed to the packaging machine, the material to be packaged is fed between the sheets, and the periphery of the sheets or compartments within the sheet are sealed to define a plurality of separate packages. It is frequently necessary to insure that certain imprinting appears in proper registration on each of the packages thus formed, such as trademarks, instructions for use, and lot and dating information. Imprinting after the formation of the package is generally not practical, and accordingly, it is necessary to imprint on one or both of the webs defining the package at particular predetermined locations on the web, which locations are selected in coordination with the operation of the packaging machinery.

In the art, several methods have been attempted in order to perform such imprinting in coordination with the packaging machinery. Such attempts have included printing using rollers operating during displacement of the webs and flat plate printing operating while the web is stopped. Neither of these approaches have proved fully satisfactory in all applications.

SUMMARY OF THE INVENTION

Generally speaking, in accordance with the invention, a marking apparatus for imprinting webs advanced intermittently therepast is provided, including carriage means mounted for reciprocal displacement parallel to the path of the web on a support means. Marking means is mounted on the carriage means and includes a rotatably mounted print roller operatively coupled to the support means for rotation during the linear displacement of the carriage means. The web passes between the carriage means and a backup plate for engagement against the backup plate by the print roller during each displacement of the carriage means to effect printing while the web is at rest.

The backup plate is provided with adjustable mounting means to insure uniform engagement of the print roller against the backup plate. The marking means includes first and second inking means positioned on opposed sides of said print roller for respectively inking said print roller during displacement of said carriage means in each of the reciprocal displacement directions. Each of the inking means includes a well formed with inwardly and downwardly projecting upper wall portions for receiving excess ink and formed with an opening through which an ink roller extends. Ink is supplied to the ink roller from an ink carrying roller. Ink is transferred from the ink roller to the print roller by a metering roller. The metering roller is supported on the carriage by rotatable eccentrics permitting adjustment of the engagement between the print and metering rollers. In addition, a wiper roller engages the metering roller to insure even distribution of ink thereon.

The print wheel is coupled to the support through a rack mounted on the support parallel to the path of the web and a gear mounted on the same shaft as the print roller and positioned for engagement with the rack. Means is provided for longitudinally positioning the rack to thereby adjust the registration of the imprinting relative to the web.

Piston means is provided for the reciprocal displacement of said carriage means under the control of fluid control means. Switch means is positioned in the path of said carriage means in advance of both rest positions thereof for actuating said fluid control means to decelerate and cushion the stopping of said carriage means.

Accordingly, it is an object of this invention to provide an improved printing device for imprinting at precise locations on an intermittently advanced web.

A further object of the invention is to provide an improved printing device for imprinting on an intermittently advanced web wherein printing is effected by a flexographic ink roller while the web is at rest.

Still other objects and advantages of the invention will in part be obvious and will in part be apparent from the specification and drawings.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 is an enlarged sectional view of the marking means in accordance with the invention during imprinting;

FIG. 5 is a sectional view taken along lines 5—5 of FIG. 4;

FIG. 6 is a partial sectional view of the inking system of another embodiment of the marking apparatus in accordance with the invention;

FIG. 7 is an enlarged sectional view of the rack adjusting mechanism in accordance with the invention; and FIG. 8 is a perspective view of a web imprinted in accordance with the invention.

DESCRIPTION OF THE PREFERRED EMBODIMENTS

Figure 1:
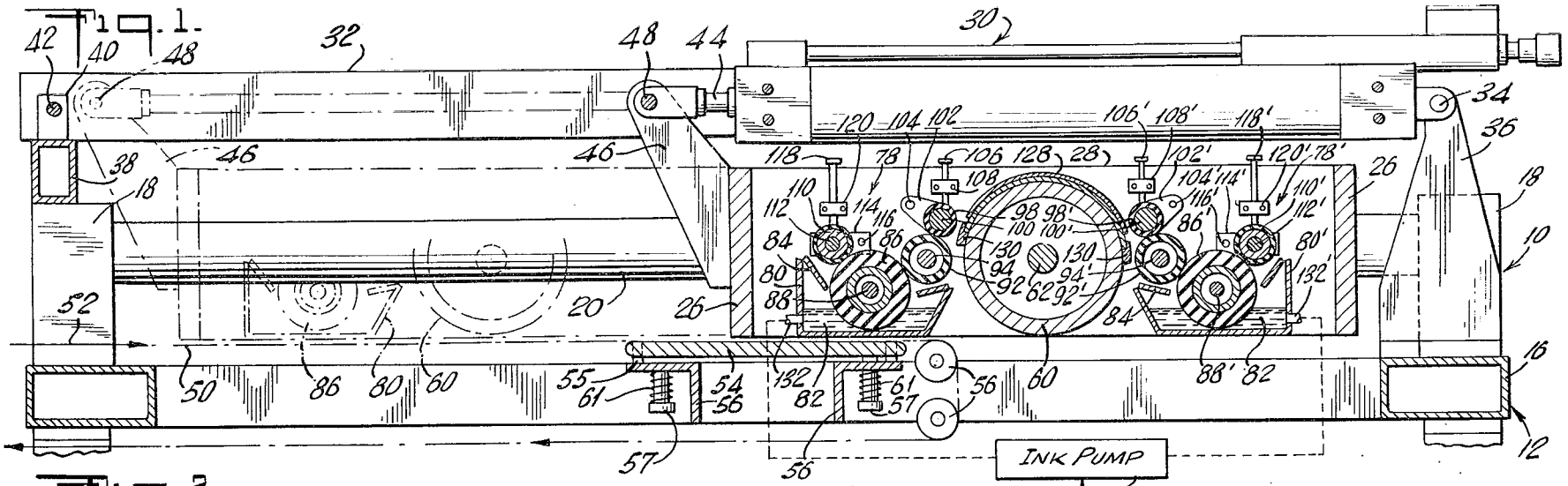
FIG. 1 is a partially sectioned, partially schematic side elevational view of the marking apparatus in accordance with the invention.
Figure 2:
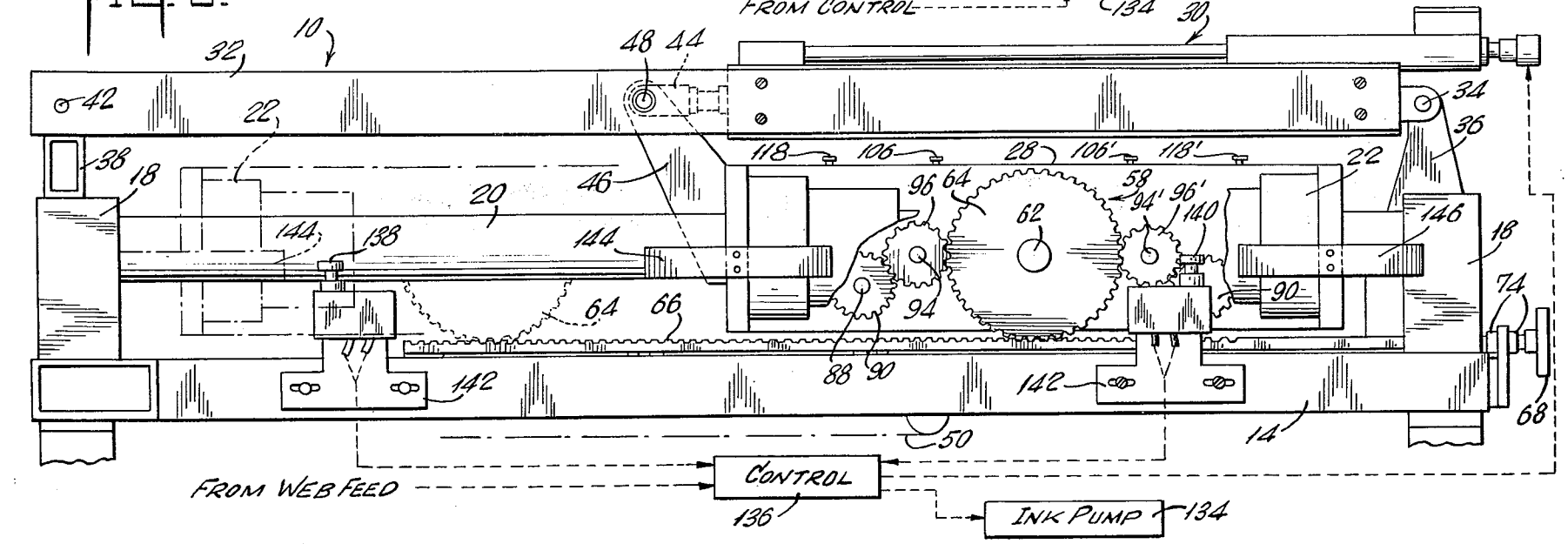
FIG. 2 is still another partially sectioned, partially schematic side elevational view of the marking apparatus of FIG. 1.
Figure 3:
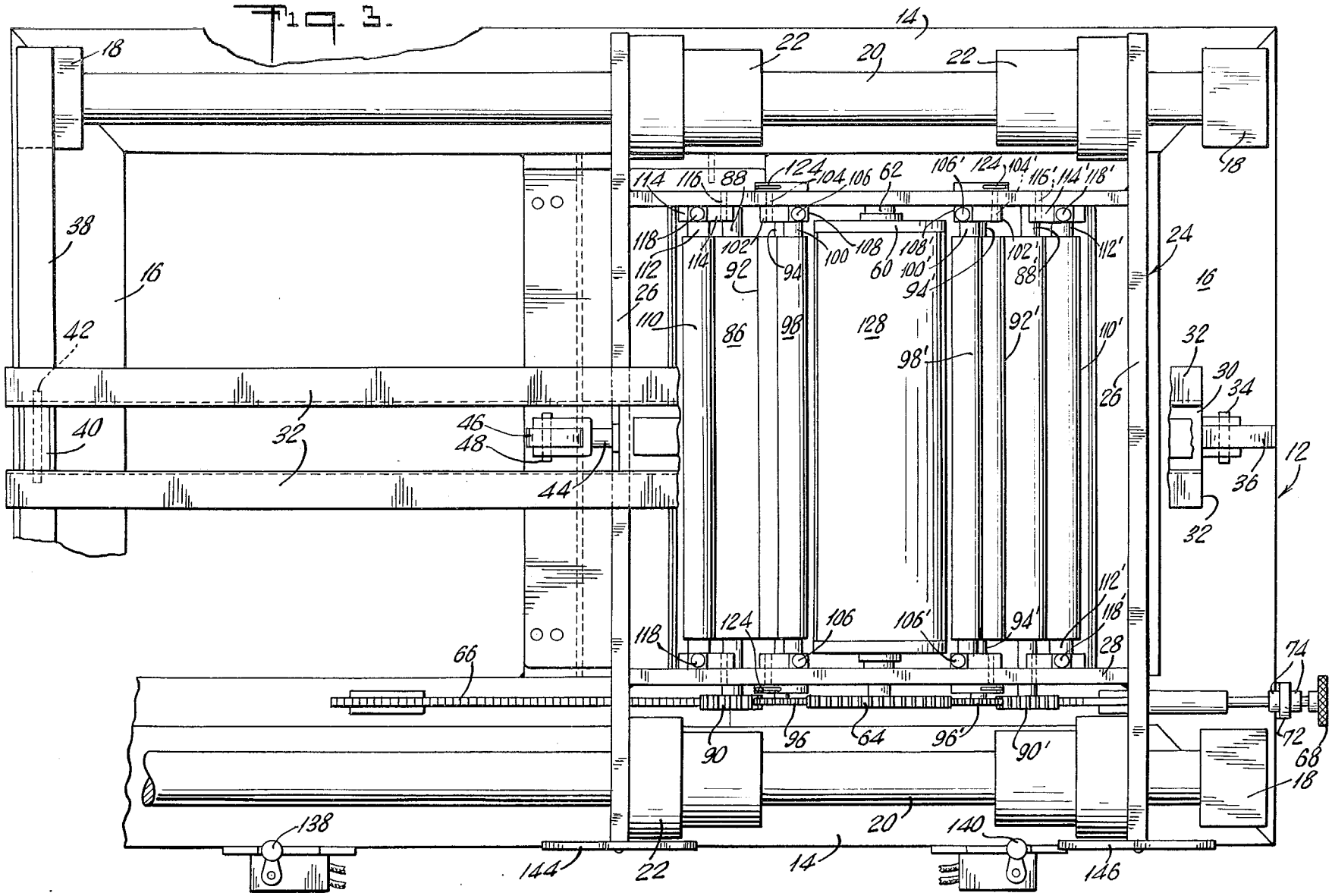
FIG. 3 is a top plan view of the marking apparatus of FIGS. 1 and 2 with portions broken away.

Referring now to FIGS. 1–3, the marking apparatus 10 depicted is provided with an essentially rectangular support frame 12 having a pair of side beams 14 and a pair of end beams 16. A corner post 18 extends upwardly from each corner of support frame 12. A bearing shaft 20 extends above and substantially parallel to each side beam 14 between each opposed pair of corner posts 18.

Mounted on said pair of bearing shafts, by means of bearings 22, is a carriage 24 provided with a pair of end walls 26 interconnecting bearings 22 and a pair of side walls 28 bridging end walls 26 inwardly of said bearing shafts.

Carriage 24 is reciprocally displaceable along bearing shafts 20 by means of a pneumatic or hydraulic piston assembly 30 mounted on a pair of piston support beams 32. Said piston support beams extend substantially parallel to side beams 14 and support frame 12 above carriage 24 midway along the length of end beams 16 of said support frame. Said piston support beams are pivotably coupled at pivot 34 to bracket 36 mounted to one of said end beams. The other end of said piston support beams rests on a cross bar 38 supported on a pair of corner posts 18 and is releasably secured to block 40 mounted on said cross bar by pin 42. While the cylinder of piston assembly 30 is fixedly mounted to piston support means 32, the piston 44 thereof is releasably coupled to carriage 24 by bracket 46 and pin 48. By releasing pins 42 and 48, piston support beams 32, carrying piston assembly 30, can be pivoted upwardly to provide free access to carriage 24. As best seen in FIG. 1, the web 50 to be imprinted passes in the direction of arrows 52 between a pair of corner posts 18, one of end beams 16 and cross bar 38, beneath the path of carriage 24 and across the upper surface of back-up plate 54. From said back-up plate, the web passes around guide rollers 56, reversing direction and passing beneath the above-mentioned end beam 16.

Back-up plate 54 is supported on a pair of angle brackets 56 bridging side beams 14. As more particularly shown in FIG. 4, back-up plate 54 is supported at each corner by a set screw 55, the adjustment of which permits leveling and vertical positioning of said back-up plate. The back-up plate is further positioned and retained by four bolts 57 extending through apertures 59 in the horizontal web of angle brackets 56 and threadably engaged in the respective corners of back-up plate 54. Each of bolts 57 is provided with a spring 61 biased between the head thereof and the horizontal web of said angle bracket to bias set screws 55 against said horizontal web.

As best shown in FIGS. 1–4, a marking assembly 58 is mounted in and carried by carriage 24. This marking assembly includes a print roller 60 rotatably mounted on shaft 62, which is journaled through and supported by carriage side walls 28. As best shown in FIGS. 2 and 3, spur gear 64 is mounted on shaft 62 outside of carriage side wall 28 for rotation with print roller 60. A rack 66 positioned for meshing engagement with spur gear 64 is mounted on the corresponding side beam 14 in the path of displacement of carriage 24. As more particularly shown in FIG. 7, rack 66 is longitudinally displaceable through rotation of knob 68 coupled to threaded rod 70 journaled through plate 72, which is in turn mounted on an end beam 16. A pair of stop nuts 74 are secured to threaded rod 70 to retain the longitudinal positioning of said threaded rod. Said rod is threaded into a corresponding aperture 76 in the end of rack 66 so that the rotation of knob 68 serves to fine-position rack 66 for a purpose more particularly described below.

Marking assembly 58 also includes a pair of inking assemblies 78 and 78' positioned on opposed sides of print roller 60. The respective inking assemblies each include an ink well 80 (80') mounted on carriage 24 for receipt of a suitable quantity of ink 82. Each of said ink wells is provided with inward and downwardly extending top walls 84 for retaining ink 82 within the respective wells during the displacement of carriage 24. Said top walls define an opening through which an ink roller 86 (86') extends into ink 82. Said ink rollers are respectively mounted on shafts 88 and 88' journaled through and supported by carriage side walls 28. A respective spur gear 90 (90') is mounted on each ink roller shaft. Ink is transferred from ink roller 86 (86') to print roller 60 through metering roller 92 (92') which is likewise mounted on a shaft 94 (94') journaled through carriage side walls 28. A spur gear 96 (96') is mounted on metering roller shaft 94 for meshing engagement with both spur gears 88 (88') and 64.

As best seen in FIGS. 1 and 4, a wiper roller 98 (98') is rotatably mounted on a shaft 100 (100'), which is in turn rotatably supported on brackets 102 (102'). Said brackets are pivotably supported on carriage side wall 28 by pivots 104 (104'). Wiper roller 98 (98') spreads and uniformly distributes the ink on metering roller 92 (92') to insure the even application of ink to print roller 60. Wiper roller 98 (98') is maintained in engagement with metering roller 92 (92') by adjusting bolt 106 (106') threaded through block 108 (108'), which is in turn mounted on carriage side wall 28. Be positioning adjusting bolt 106 (106'), the engagement of wiper roller 98 (98') against metering roller 92 (92') can be adjusted to apply controlled amounts of ink to the print roller.

An anti-puddling roller 110 (110') is rotatably mounted on a shaft 112 (112'), which is in turn mounted on a pair of brackets 114. Said brackets are pivotably mounted on carriage side walls 28 by means of pivots 116 (116'). A second adjusting bolt 118 (118') is threaded through block 120 (120') for engagement against one of brackets 114 (114') to forceably engage anti-puddling roller 110 (110') against ink roller 86 (86') to prevent in from being carried out of well 80 (80') and into the pocket defined by metering roller 92 (92') and ink roller 86 (86') when the respective ink roller is rotated in the reverse direction as will be more particularly described below.

As is more particularly shown in FIG. 5, the degree of engagement between metering roller 92 (92') and ink roller 60 may be selectively adjusted by rotation of eccentric cam 122 by means of lever 124, shaft 94 being journaled through and supported by said eccentric cam in carriage side wall 28.

As is best shown in FIG. 4, print roller 60 is provided with a removable marking plate 126 having projecting indicia 128 thereon representative of the indicia to be imprinted. Said marking plate is releasably retained on print roller 60 by means of brackets 130. Controlled amounts of ink are supplied to wells 80 and 80' through conduits 132 (132') from an ink pump 134. Said ink pump is automatically controlled to provide the desired amounts of ink to the respective wells by a control device 136.

Said control device is actuated by a signal received from the web feed mechanism of the parent device such as a packaging machine. Thus, after each incremental advance of web 50, control 136 would be actuated to displace carriage 24 between the two positions depicted in FIGS. 1 and 2, one in solid lines and one in chain lines. During each rest interval of the web, the carriage is displaced either from left to right or from right to left. As seen in FIGS. 2 and 3, microswitches 138 and 140 are mounted by means of supports 142 on side beam 14 in the path of displacement of carriage 24 but spaced from the respective rest positions of said carriage. Thus, microswitch 138 is tripped by trip plate 144 mounted on carriage 44 before said carriage reaches the extreme left (as viewed in FIGS. 1–3) rest position. Similarly, microswitch 140 is tripped by trip plate 146 as the carriage traverses from left to right but before the carriage reaches the extreme right rest position. Microswitches 138 and 140 are coupled to control device 136 which actuates the fluid system of piston assembly 30 to cushion and decelerate the carriage before reaching the respective rest positions. The traverse of the carriage as indicated by control 136 also actuates the ink pump to provide ink to the respective wells to compensate for the ink consumed during operation.

The marking apparatus in accordance with the invention operates as follows.

As shown in FIG. 8, a web 50 may be divided into segments by a packaging machine as indicated by dashed lines 148. It is necessary to provide markings 150 at precisely registered positions on each segment during the intermittent feeding of web 50. This is achieved by the printing apparatus in accordance with the invention by the traverse of carriage 24 either from left to right or right to left after each incremental advance of web 50. Such traverse causes spur gear 64 to ride on rack 66 to rotate print roller 60, which in turn rotates ink roller 86 (86') and metering roller 92 (92'). As can be seen from FIGS. 1 and 4, the indicia 128 occupies less than the entire surface of the print roller so that at the respective rest positions, the metering rollers 92 and 92' are out of engagement with indicia 128. However, for example, as the carriage is traversed from right to left as viewed in the figures, print roller 60 rotates in the direction of arrow 152 to engage indicia 128 against the portion of web 50 supported by back up plate 54. Ink is transferred from ink roller 86 to metering roller 92 and spread and made uniform by wiper roller 98 for transfer to indicia 128. During the next cycle, when the carriage moves from left to right, ink would tend to be carried by ink roller 86 into the pocket defined between said ink roller and metering roller 92. Adjusting knob 68 permits fine positioning of rack 66, and therefore print roller 60, relative to backup plate 54. This adjustment permits precise registration of the markings relative to predetermined regions of web 50.

While the inking apparatus depicted in the embodiment of the drawings includes an ink well, other inking arrangements can be utilized, such as ink rollers preimpregnated with ink for dispensing upon contact.

Referring to FIG. 6, an alternate inking arrangement in accordance with the invention is depicted, corresponding in structure to the inking arrangement depicted in FIG. 4, but differing in that the ink is not supplied from the well 80, but rather, from an ink carrying roller 160 mounted on shaft 162. The ink carrying roller 160 may consist of a roller impregnated with ink, which ink is transferred to ink roller 86, or may contain a central reservoir of ink which passes through the surface material of ink carrying roller 160. Said ink carrying roller would be removably mounted on the printing device for the substitution of new ink carrying rollers as required. This arrangement avoids the necessity of the relatively complicated ink feeding mechanism of the embodiment of FIGS. 1–3 and also minimizes the likelihood of ink spillage. The removably mounted ink carrying roller can be pivotably mounted in the same manner as the anti-puddling roller 110 for the selective adjustment of the pressure of engagement between said ink-carrying roller and ink roller 86. Well 80 is provided to receive excess ink and to prevent the spillage thereof.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A marking apparatus for imprinting webs advanced intermittently therepast comprising support means; back up plate means carried by said support means on one side of the path of said web; carriage means mounted on said support means for linear reciprocal displacement parallel to said web on the side thereof opposed to said back up plate means; marking means carried by said carriage means and including a print roller positioned for operative engagement of said web against said back up plate means during displacement of said carriage means to effect printing, at least one ink carrying roller for supplying ink for said print roller and transfer roller means for supplying ink to said print roller from said ink carrying roller; means for coordinately linearly displacing said carriage means and rotatably displacing said print roller in opposite directions parallel to the direction of advance of said web alternately during successive periods of rest of said web, said means for displacing said print roller including rack means mounted on said support means in the path of said carriage means and sput gear means operably coupled to said print roller for coordinate rotation therewith and positioned for meshing engagement with said rack means for rotational displacement thereby during the linear displacement of said carriage means and means for selectively linearly displacing said rack means relative to said support means for fine positioning said print roller relative to said backup plate; switch means positioned in the path of displacement of said carriage means in advance of each of the two respective rest positions thereof for actuation by said carriage means in advance of reaching said rest positions; and control means for decelerating and cushioning the stopping of said carriage means in advance of each of said rest positions in response to the actuation of said switch means.

2. A marking apparatus as recited in claim 1, wherein said marking means includes first and second of said ink carrying rollers and transfer roller means mounted on said carriage means on opposed sides of sais print roller for respectively inking said print roller during displacement thereof in each direction.

3. A marking apparatus as recited in claim 2, wherein said marking means includes first and second well means, said first and second transfer roller means each including an ink roller engaging the associated ink carrying roller for receiving ink therefrom and extending into said well means, said well means receiving excess ink therefrom, and a metering roller in pressing engagement with both said ink roller and print roller for the transfer of ink to said print roller.

4. A marking apparatus as recited in claim 3, wherein both said well means are provided with inwardly and downwardly projecting top walls for retaining ink therein during displacement of said carriage means and defining an opening through which said respective ink rollers extend.

5. A marking apparatus as recited in claim 3, wherein said ink carrying rollers are each pivotably mounted on said carriage means, and including adjusting means for adjusting the pressure of each of said ink carrying rollers against said ink roller.

6. A marking apparatus as recited in claim 3, including a wiper roller engaging each of said metering rollers at a point thereon intermediate the respective ink and print rollers viewed in the direction of rotation of said metering roller during inking of said print roller thereby.

7. A marking apparatus as recited in claim 6, wherein said wiper roller is pivotably mounted on said carriage, and including means for adjusting the pressure of engagement of said wiper roller against said metering roller.

8. A marking apparatus as recited in claim 3, including eccentric cam means for supporting each of said metering rollers, and means for selectively rotating said eccentric cam means for selectively determining the engagement pressure between said metering roller and print roller.

9. A marking apparatus as recited in claim 1, wherein said print roller is provided with a removable marking plate bearing indicia to be imprinted and means for releasably securing said marking plate on said print roller.

10. A marking apparatus as recited in claim 9, wherein the outer diameter of said print roller outside of the region of said indicia is less than the outer diameter of said print roller in the region of said indicia, said indicia occupying a portion of the circumference of said print roller such that the respective metering rollers do not engage said print roller at the respective rest positions of said carriage means.

11. A marking apparatus as recited in claim 1, including means for selectively adjusting the level and height of said backup plate means.

12. A marking apparatus as recited in claim 11, wherein said backup plate adjusting means includes a set screw at each corner of said backup plate means supporting said backup plate means, and means biasing said supporting set screws against said support means.

13. A marking apparatus as recited in claim 1, wherein said means for displacing said carriage means includes fluid actuated piston means operatively coupled to said control means.

14. A marking apparatus as recited in claim 13, including piston support means pivotably mounted above said carriage means on said support means pivotably mounted above said carriage means on said support means and carrying said fluid actuated piston means, said fluid actuated piston means being releasably coupled to said carriage means.

* * * * *